US007861900B2

(12) United States Patent
Ryan

(10) Patent No.: US 7,861,900 B2
(45) Date of Patent: Jan. 4, 2011

(54) FLUID DISPENSING SYSTEM

(76) Inventor: Kevin A. Ryan, 215 Birch Ave., Melbourne Beach, FL (US) 32957

( * ) Notice: Subject to any disclaimer, the term of this patent is extended or adjusted under 35 U.S.C. 154(b) by 710 days.

(21) Appl. No.: 11/842,985

(22) Filed: Aug. 22, 2007

(65) Prior Publication Data

US 2009/0052975 A1 Feb. 26, 2009

(51) Int. Cl.
*B67D 3/00* (2006.01)
*B65D 51/16* (2006.01)

(52) U.S. Cl. ..... 222/482; 222/481.5; 222/189.09; 215/260; 215/308; 215/311; 220/203.19; 220/203.29

(58) Field of Classification Search ..... 222/478, 222/481, 482, 481.5, 477, 189.09; 215/11.5, 215/270, 260, 308, 307, 311; 220/203.1, 220/203.5, 203.19, 203.29, 367.1, 371, 361, 220/62.1, 676
See application file for complete search history.

(56) References Cited

U.S. PATENT DOCUMENTS 3,872,872 A 3/1975 Kahler
D244,473 S 5/1977 Karl
4,031,904 A 6/1977 Karl
4,041,960 A 8/1977 Kahler
4,244,383 A 1/1981 Kahler
D355,274 S 2/1995 Newman
5,487,490 A * 1/1996 Estes ..... 222/1
D368,324 S 3/1996 Heine
D381,116 S 7/1997 Richards
5,967,147 A 10/1999 Newman
6,220,311 B1 * 4/2001 Litto ..... 141/67
6,253,935 B1 * 7/2001 Fletcher ..... 215/11.1
2005/0167454 A1 * 8/2005 Botero et al. ..... 222/556
2007/0034219 A1 2/2007 Affinito

* cited by examiner

*Primary Examiner*—Kenneth Bomberg
*Assistant Examiner*—Stephanie E Williams
(74) *Attorney, Agent, or Firm*—Neustel Law Offices

(57) ABSTRACT

A fluid dispensing system for efficiently rapidly dispensing fluid for a user to drink. The fluid dispensing system generally includes a container including an upper end, a lower end, a cavity and an upper opening, wherein the upper end is opposite the lower end, wherein the upper opening extends within the upper end and wherein the cavity extends from the upper opening of the upper end toward the lower end. A release valve extends within the container, wherein the release valve includes a channel extending through the release valve and wherein the release valve selectively seals the channel.

20 Claims, 7 Drawing Sheets

FLUID DISPENSING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to beverage containers and more specifically it relates to a fluid dispensing system for efficiently rapidly dispensing fluid for a user to drink.

2. Description of the Related Art

Any discussion of the prior art throughout the specification should in no way be considered as an admission that such prior art is widely known or forms part of common general knowledge in the field.

Beverage containers have been in use for years. Typically, beverage containers are comprised of various sizes, shapes and configurations. Examples of commonly utilized beverage containers include cans (e.g. 12 ounce, etc.), plastic bottles (e.g. 20 ounce pop bottles, etc.), glass bottles (e.g. 12 ounce alcoholic beverage bottles, etc.), mugs, cups and various others. Beverage containers may also be utilized to store fluid for long durations of time or be utilized to transfer fluid from a larger storage container to a more manageable smaller container (e.g. large pitcher to a small mug, etc.).

A popular pastime for many individuals, while drinking various beverages (e.g. alcoholic, etc.), is to drink the liquid as rapidly as possible (i.e. "shooting" beverages, "shotgun" beverages, etc.). Rapidly drinking the liquid from a can or bottle may be difficult in that air bubbles generally form within the can or bottle thus preventing the liquid from being rapidly dispensed. Also, when dispensing the liquid from prior beverage containers the liquid is generally dispensed form the beverage container in a non-uniform or inconsistent manner thus causing the user to more easily spill the liquid upon themselves. Because of the general lack of efficiency and practicality in the prior art there is the need for a new and improved fluid dispensing system for efficiently rapidly dispensing fluid for a user to drink.

BRIEF SUMMARY OF THE INVENTION

The general purpose of the present invention is to provide a fluid dispensing system that has many of the advantages of the beverage containers mentioned heretofore. The invention generally relates to a beverage container which includes a container including an upper end, a lower end, a cavity and an upper opening, wherein the upper end is opposite the lower end, wherein the upper opening extends within the upper end and wherein the cavity extends from the upper opening of the upper end toward the lower end. A release valve extends within the container, wherein the release valve includes a channel extending through the release valve and wherein the release valve selectively seals the channel.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a fluid dispensing system for efficiently rapidly dispensing fluid for a user to drink.

Another object is to provide a fluid dispensing system that is easily utilized.

An additional object is to provide a fluid dispensing system that dispenses the fluid from the container in a uniform and consistent manner.

A further object is to provide a fluid dispensing system that may be utilized to seal the liquid within the container.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
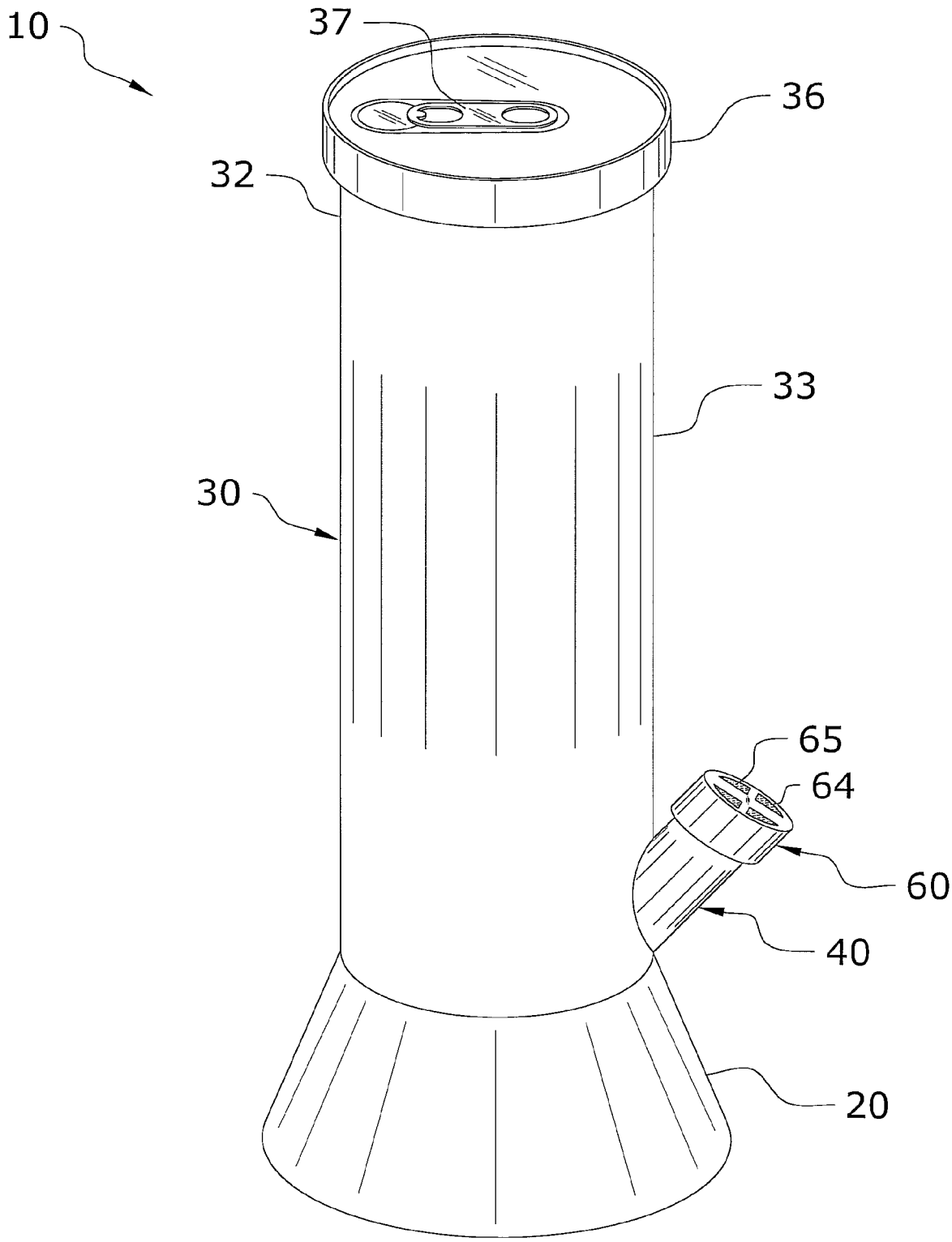
FIG. 1 is an upper perspective view of the present invention.
Figure 2:
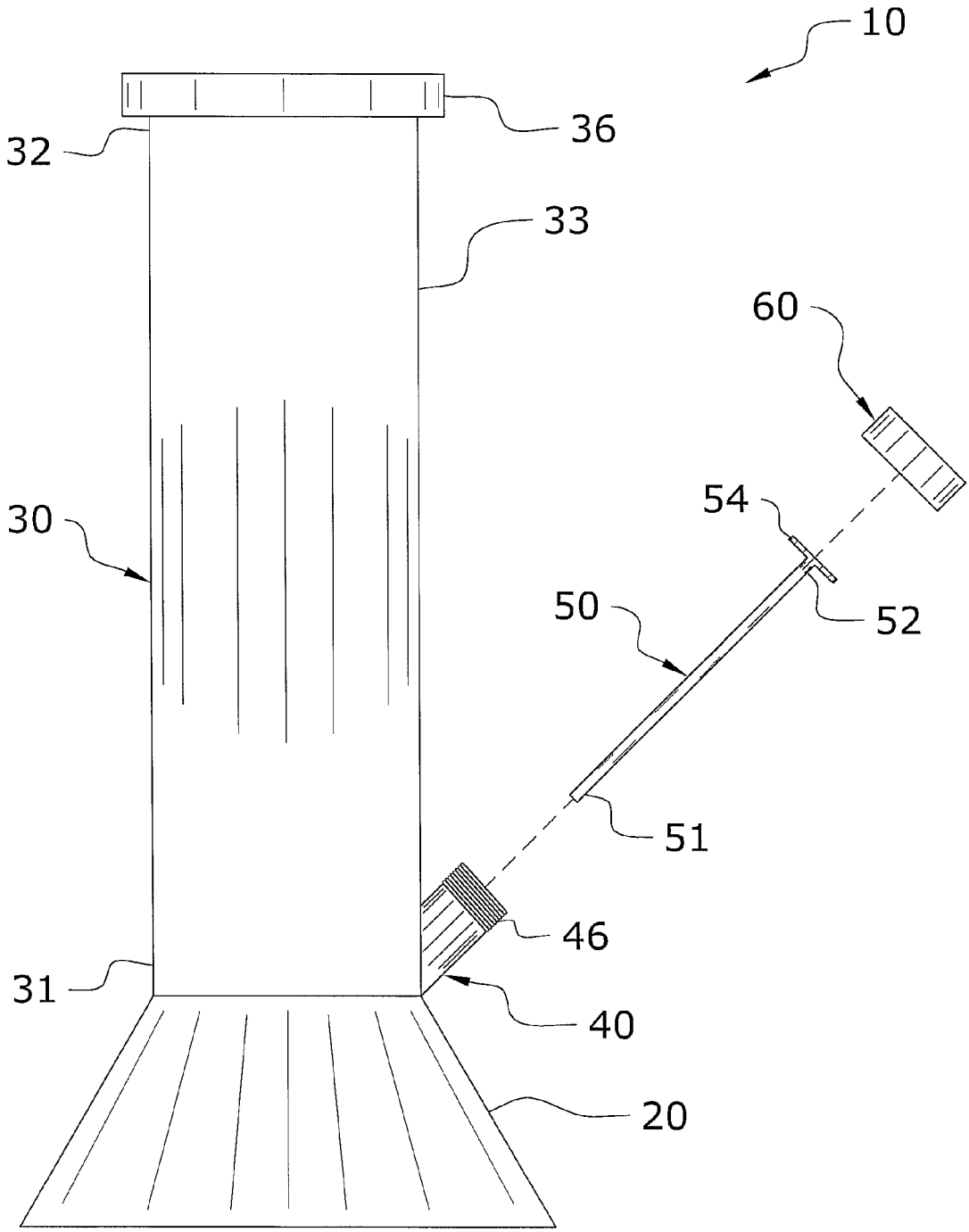
FIG. 2 is a side view of the present invention with the air needle and the valve cap exploded outwards.

Turning now descriptively to the drawings, in which similar reference characters denote similar elements throughout the several views, FIGS. 1 through 7 illustrate a fluid dispensing system 10, which comprises a container 30 including an upper end 32, a lower end 31, a cavity 34 and an upper opening 35, wherein the upper end 32 is opposite the lower end 31, wherein the upper opening 35 extends within the upper end 32 and wherein the cavity 34 extends from the upper opening 35 of the upper end 32 toward the lower end 31. A release valve 40 extends within the container 30, wherein the release valve 40 includes a release channel 56 extending through the release valve 40 and wherein the release valve 40 selectively seals the channel 56.

B. Base

The base 20 secures the container 30 upon a supporting structure (e.g. table, floor, hand of a user, etc.), wherein the base 20 stabilizes the container 30 in an upright manner. The base 20 may be comprised of various materials, such as but not limited to plastic. The base 20 may be comprised of various configurations all which efficiently support the container 30 and present invention in an upright manner. In the preferred embodiment, the base 20 is comprised of a triangular configuration; however it is appreciated that the base 20 may be comprised of various shaped configurations rather than the preferred embodiment, such as but not limited to rectangular.

The container 30 is preferably positioned within a recessed portion 22 of the base 20 as illustrated in FIGS. 3 through 6. The recessed portion 22 extends within the upper portion of the base 20 and towards the lower end 31 adjacent the support structure. The recessed portion 22 is preferably comprised of a substantially similar cross-sectional configuration as the lower end 31 of the container 30, wherein the container 30 snugly fits within the recessed portion 22. It is appreciated that various fastening methods may be utilized to secure the lower end 31 of the container 30 within the recessed portion 22 (e.g. adhesive, fasteners, etc.). It is also appreciated that the base 20 and the container 30 may be comprised of separate structures or integrally formed.

C. Container

Figure 5:
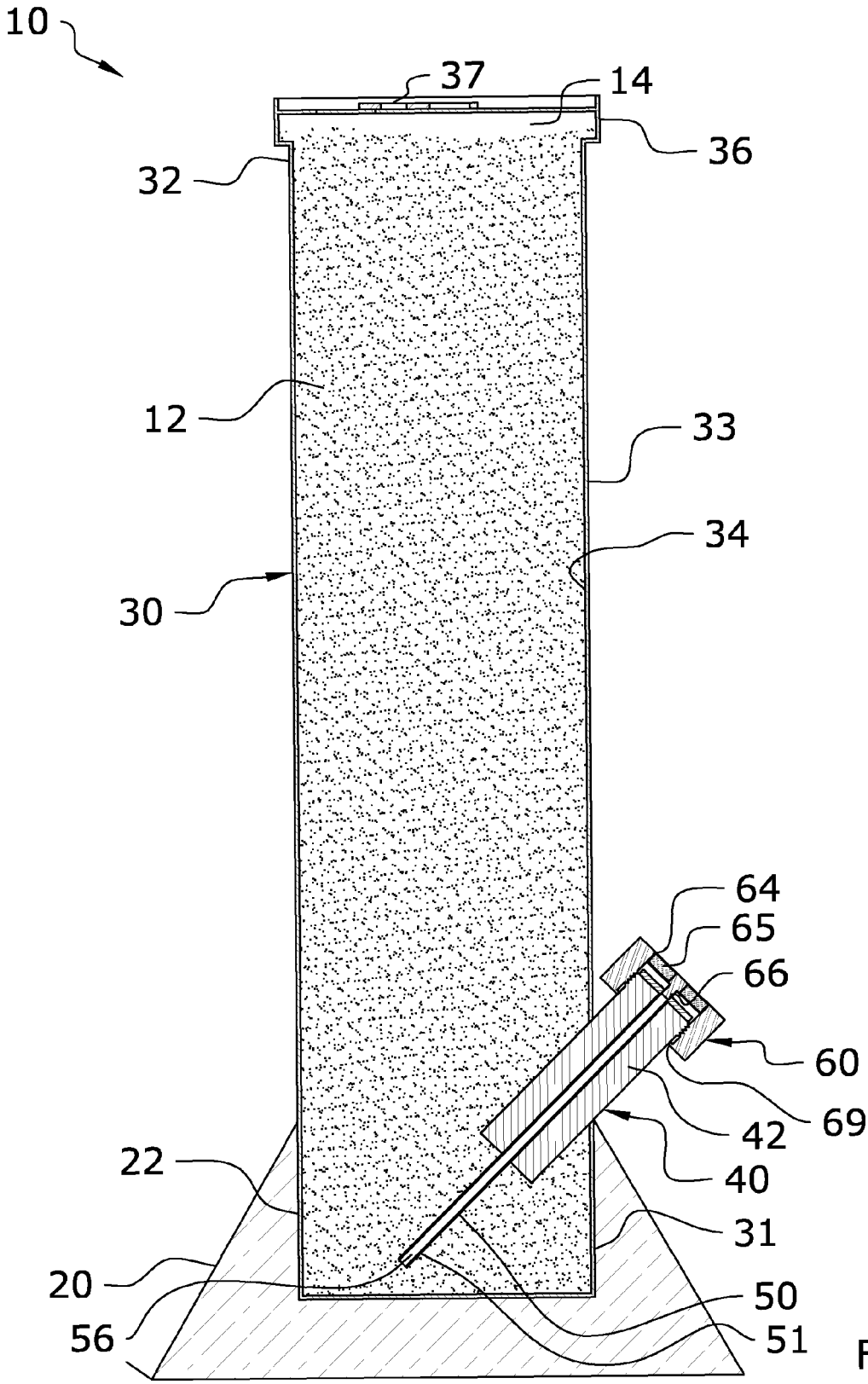
FIG. 5 is a side cross-sectional view of the present invention filled with liquid, wherein the liquid is sealed within.
Figure 6:
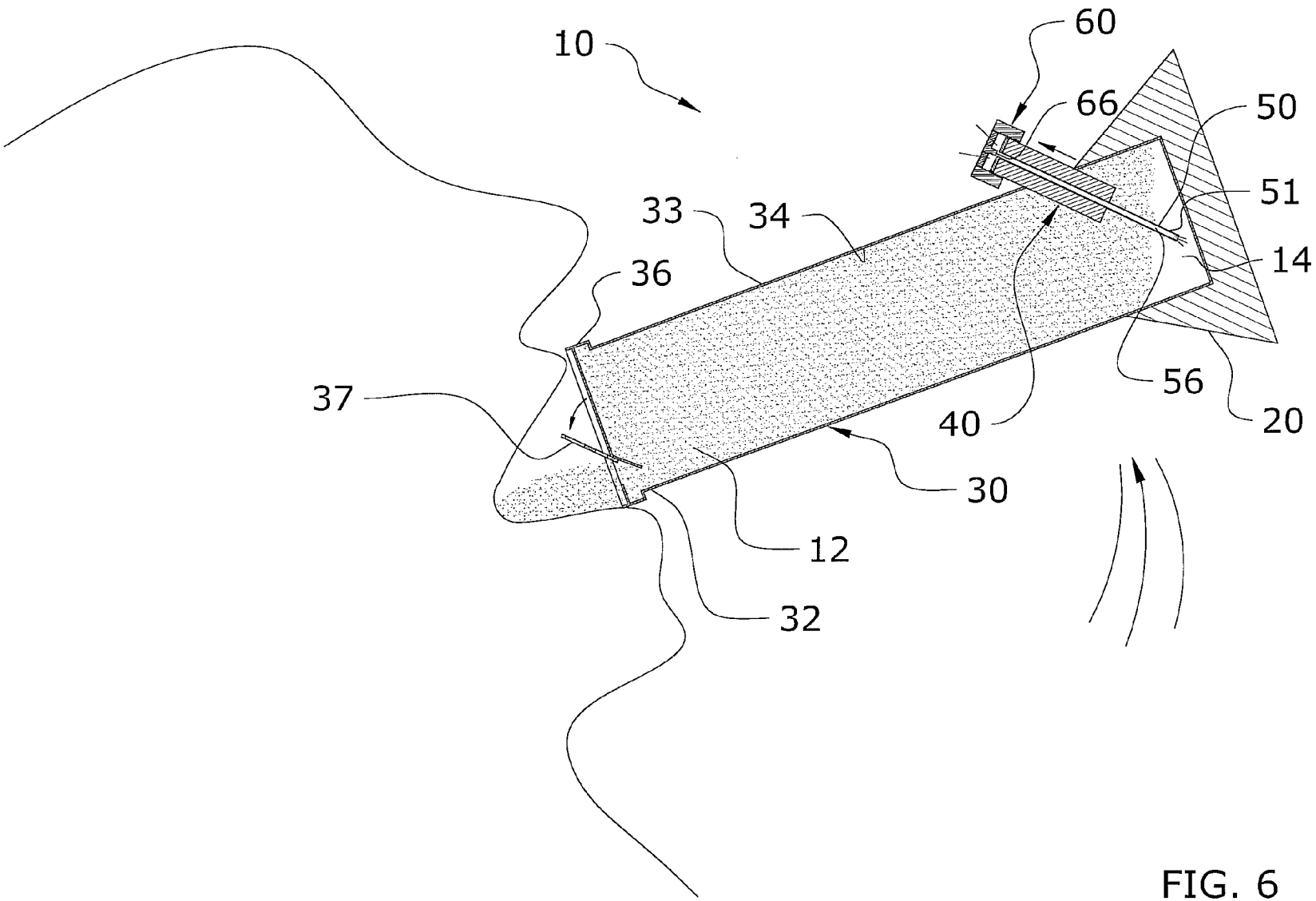
FIG. 6 is a side cross-sectional view of the present invention filled with liquid being released from the upper opening, wherein the release valve is in an open position.

The container 30 is comprised of an elongated and hollow configuration, wherein the container 30 holds a mass of liquid 12 (e.g. beer, alcohol, etc.) within as illustrated in FIGS. 5 and 6. The container 30 may be comprised of various materials, such as but not limited to plastic. The container 30 is preferably comprised of a cylindrical shaped configuration; however is appreciated that the container 30 may be comprised of various other shapes, such as an ovular cross-sectional shape or a rectangular cross-sectional shape.

The container 30 includes the lower end 31, an upper end 32 and a tubular portion 33 extending between thereof. The lower end 31 is positioned within the recessed portion 22 of the base 20 as described previously. The lower end 31 is further preferably concentric with the base 20 so as to provide a more steady overall structure of the present invention when the present invention is positioned in an upright manner. The upper end 32 is distally spaced from the lower end 31, wherein the tubular portion 33 is of a sufficient length to hold a desired amount of liquid 12 (e.g. 1 ounce, 4 ounces, 12 ounces, 16 ounces, 24 ounces, etc.). The container 30 further is preferably comprised of a 7:1 height to width ratio; however it is appreciated that the container 30 may be comprised of various height to width ratios rather than the preferred embodiment.

The container 30 includes a cavity 34, wherein the cavity 34 extends within the tubular portion 33 and further extends an entire length of the tubular portion 33 and holds the liquid 12. The upper end 32 of the container 30 and cavity 34 are also sealed via a lid 36. It is appreciated that the lid 36 may be removably attached or fixedly attached to the upper end 32 of the container 30. It is also appreciated that the lid 36 may be integrally formed with the container 30 or separably formed. The liquid 12 of the container 30 may be released from the cavity 34 via the lid 36, a tab 37 or an upper cap 38, wherein the lid 36, tab 37 and upper cap 38 may be interchanged or may not all be included in the present invention as long as the present invention includes at least one cover (i.e. lid 36, tab 37 or upper cap 38) to selectively release the liquid 12 within the cavity 34 from the upper end 32 of the container 30.

The present invention includes an upper opening 35 extending within the upper end 32 of the present invention and interconnecting with the cavity 34. The upper opening 35 is preferably positioned near an outer perimeter of the upper end 32 (offset the center) so as to allow the user to more easily drink from the upper opening 35. The upper opening 35 further preferably extends through the lid 36 of the present invention. In the preferred embodiment the upper opening 35 is selectively sealed via the tab 37, wherein the tab 37 is preferably comprised of a pop can tab configuration as illustrated in FIGS. 5 and 6 and may selectively open the upper opening 35 via pivoting the tab 37 about the lid 36.

Figure 7:
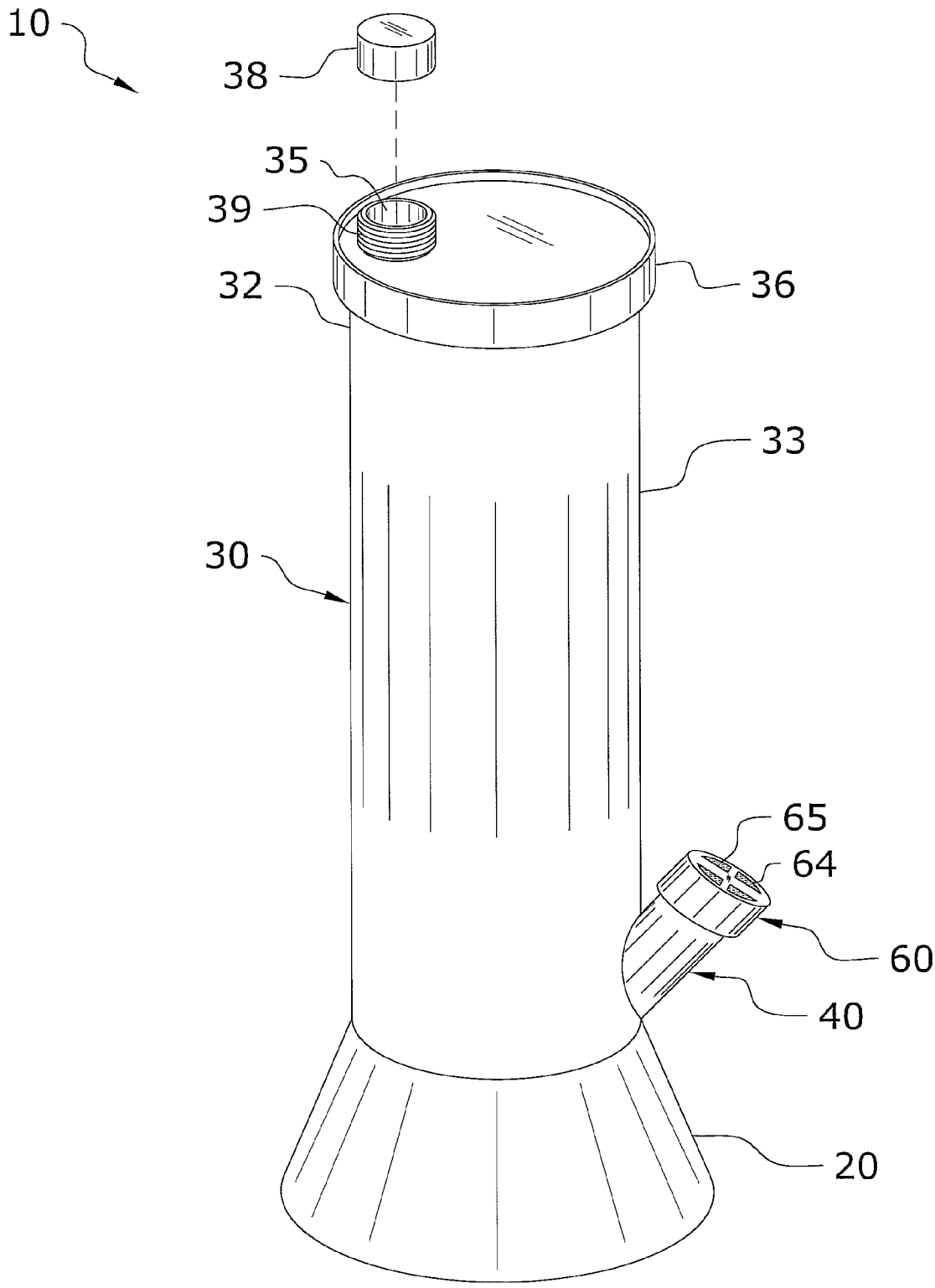
FIG. 7 is an upper perspective view of an alternate embodiment of the present invention.

It is appreciated that in an alternate configuration of the present invention, the container 30 may include an attachment portion 39 extending upwards form the upper end 32 or the lid 36 of the container 30. The attachment portion 39 selectively receives and attaches to the upper cap 38, wherein the upper cap 38 and the attachment portion 39 preferably threadably attach as illustrated in FIG. 7. In yet another alternate embodiment of the present invention the lid 36 may threadably attach to the upper end 32 of the container 30, wherein the lid 36 is selectively removed to allow the liquid 12 to be released from the cavity 34.

The cavity 34 of the container 30 is preferably not filled completely full of liquid 12, wherein a small amount of air 14 or other gaseous substance is left within the cavity 34 to create an air pocket 14 within the lower end 31 of the cavity 34 when utilizing the present invention. The cover (i.e. lid 36, tab 37 or upper cap 38) also maintains a vacuum sealed cavity 34, wherein the present invention may maintain carbonation within the liquid 12 over an extended period of time.

D. Release Valve

The release valve 40 extends within the container 30 adjacent the lower end 31 and preferably just above the base 20. The release valve 40 further extends within the cavity 34 of the container 30 and toward a lower corner of the cavity 34 vertically below the upper opening 35. The release valve 40 further extends a sufficient distance within the cavity 34 to be at least partially positioned within a lower air pocket 14 formed when tipping the container 30 as illustrated in FIG. 6.

i. Securing Member

The release valve 40 includes a securing member 42 extending from and partially within the container 30. The securing member 42 may be comprise of various configurations, such as but not limited to cylindrical. The securing member 42 may also be integrally formed within the container 30. If separably attached, the securing member 42 is attached in such a manner as to prevent liquid 12 or air from leaking out of the cavity 34 around the outer perimeter of the securing member 42.

The securing member 42 also includes a retaining channel 44 longitudinally extending through the securing member 42. The retaining channel 44 is preferably concentric with the securing member 42. The securing member 42 also preferably includes a first connecting portion 46 opposite the cavity 34 and around an outer perimeter of the securing member 42 as illustrated in FIGS. 3 through 6. The first connecting portion 46 is preferably threadably formed so as to threadably receive and attach to a second connecting portion 68 of a valve cap 60.

ii. Air Needle

The release valve 40 also includes an air needle 50 extending within the release valve 40 to selectively allow a passageway for the air within the air pocket 14 to escape the cavity 34 as illustrated in FIG. 6. The air needle 50 is comprised of an elongated configuration. The air needle 50 is further preferably comprised of a cylindrical shaped configuration. The air needle 50 is further preferably concentric with the securing member 42 and extends at a substantially similar angle as the securing member 42.

The air needle 50 includes an inner end 51 and an outer end 52 opposite the inner end 51 and also preferably distally spaced from the inner end 51. The air needle 50 is positioned within the retaining channel 44 of the securing member 42. The inner end 51 extends within toward the opposing lower corner so as to fluidly connect with the air pocket 14 when the container 30 is tilted.

The outer end 52 extends toward outer side of the retaining channel 44 of the securing member 42. The outer diameter of the needle between the inner end 51 and the outer end 52 is preferably substantially similar or slightly smaller than the diameter of the retaining channel 44. It is appreciated that the air needle 50 may be fixedly attached within the retaining channel 44 of the securing member 42 or removably positioned within the retaining channel 44 of the securing member 42.

A retaining portion 54 preferably radiates from the outer end 52 of the air needle 50 and is positioned substantially over an outer side of the securing member 42 as illustrated in FIGS. 2 through 6. The outer diameter of the retaining portion 54 is thus substantially larger than the outer diameter of the air needle 50 between the inner end 51 and the outer end 52, wherein the retaining portion 54 prevents the air needle 50 from falling completely within the retaining channel 44 and cavity 34 and further suspends the inner end 51 slightly above the lowermost end of the cavity 34. The retaining portion 54 is further preferably comprised of a disc shaped configuration.

iii. Valve Cap

The release valve 40 also includes a valve cap 60 positioned over the outer end 52 of the release channel 56 to selectively seal the release channel 56 and also to open the release channel 56 for air passage during use of the present invention. The valve cap 60 may be comprised of various materials such as but not limited to plastic.

The valve cap 60 includes a first end 61 and a second end 62 opposite the first end 61. Extending through the first end 61 is preferably a plurality of cap openings 64 to allow air from the air pocket 14 to be released during use of the present invention. The valve cap 60 also preferably includes an absorbent pad 65 extending across the cap openings 64 to prevent any liquid 12 that may have been within the release channel 56 of the air needle 50 from escaping through the openings and subsequently spill on the user of the present invention. The absorbent pad 65 preferably soaks up any liquid 12 that attempts to pass through the cap openings 64, but allows the air from the air pocket 14 to pass through substantially unrestricted.

Extending within the second end 62 of the valve cap 60 and toward the first end 61 is a valve cavity 63. The second connecting portion 68 of the valve cap 60 extends within the valve cavity 63 between the first end 61 and the second end 62. The second connecting portion 68 is preferably threadably formed, wherein the second connecting portion 68 is comprised of the female attachment structure to attach to the male attachment structure (i.e. first connecting portion 46 of the securing member 42).

The valve cap 60 also includes an inner lip 69 extending within the valve cavity 63 adjacent the second end 62 of the valve cap 60. The inner diameter of the inner lip 69 is preferably substantially similar to the outer diameter of the securing member 42. The inner lip 69 engages the first connecting portion 46 of the securing member 42 when the valve cap 60 is moved towards the open position and prevents the valve cap 60 from being removed so the user does not lose the valve cap 60 between uses of the present invention.

Figure 3:
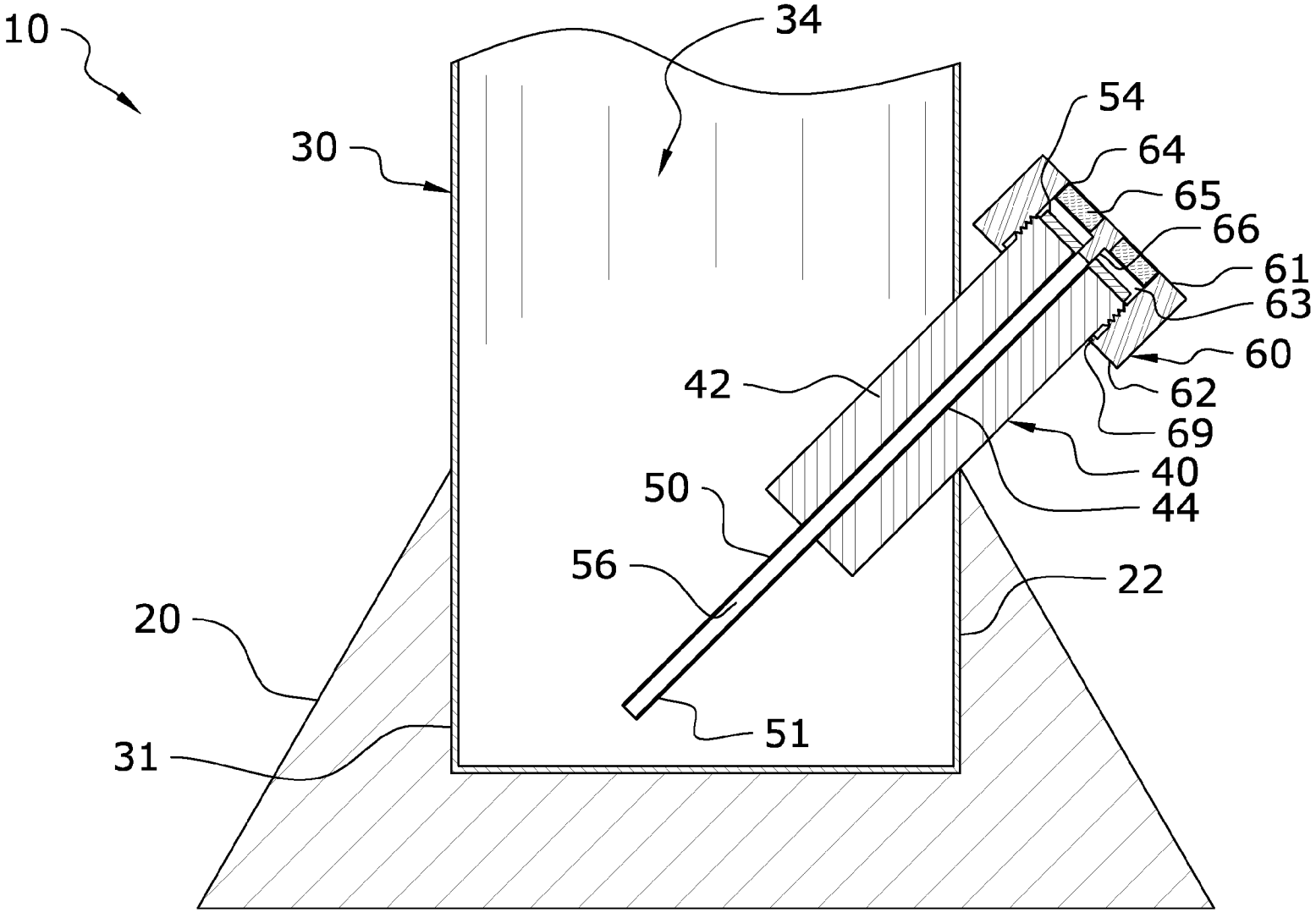
FIG. 3 is a side cutaway cross-sectional view of the present invention with the release valve in a closed position.

The valve cap 60 also includes a sealing member 66 extending from the first end 61 of the cap towards the second end 62 and within the valve cavity 63. The sealing member 66 is concentric with the valve cap 60 and is also preferably comprised of a substantially similar diameter as the release channel 56. The sealing member 66 extends within the release channel 56 when the valve cap 60 is in the closed position as illustrated in FIGS. 3 and 5.

Figure 4:
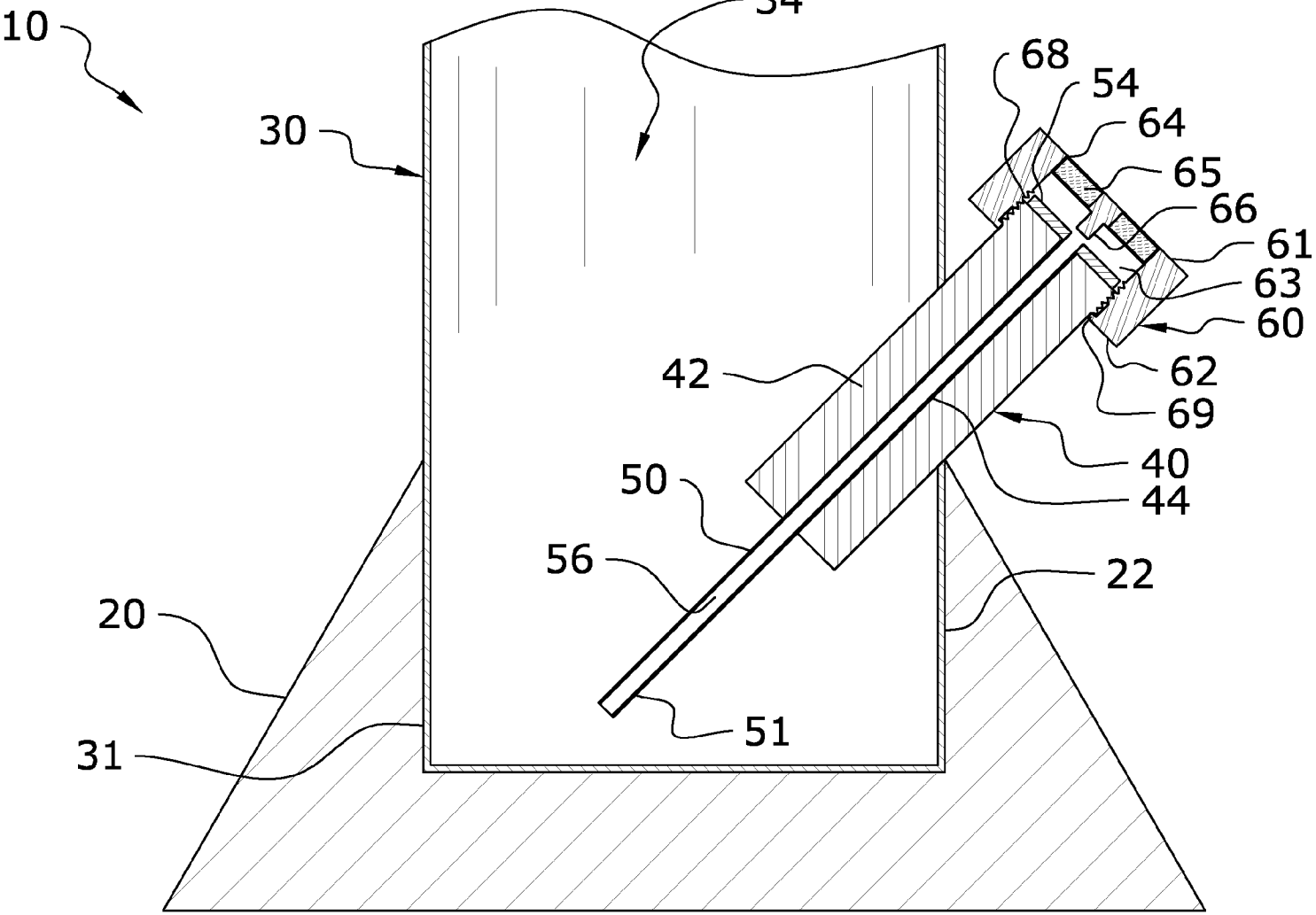
FIG. 4 is a side cutaway cross-sectional view of the present invention with the release valve in an open position.

The sealing member 66 seals the release channel 56 and prevents any air or liquid 12 from escaping the cavity 34 through the release channel 56. When the valve cap 60 is moved towards the open position, the sealing member 66 is moved out of the release channel 56 and allows the release channel 56 to fluidly connect with the cap openings 64 to allow the air within the air pocket 14 to escape the cavity 34 via the release channel 56 as shown in FIGS. 4 and 6.

E. Operation of Preferred Embodiment

In use, the cavity 34 is preferably prefilled with the liquid 12 prior to usage and vacuum sealed by the manufacturer as illustrated in FIG. 5. It is also appreciated that the cavity 34 may be refilled after usage to reutilize the present invention. When the user is ready to utilize the present invention the base 20 or tubular portion 33 of the container 30 is firmly grasped by the user.

The user then opens upper opening 35 via pivoting the tab 37. The user then lifts and tilts the container 30 to extend the upper opening 35 of the container 30 toward the mouth of the user (so as to drink the liquid 12). When the upper opening 35 is near the mouth of the user, the valve cap 60 is rotated in a counterclockwise manner (i.e. loosened) until the inner lip 69 engages the first connecting portion 46 of the securing member 42 thus opening the release channel 56.

Ensuring that the container 30 remains tilted the liquid 12 is rapidly dispensed from the upper opening 35 into the user's mouth. The liquid 12 is able to rapidly dispense in a consistent manner because the air within the air pocket 14 is able to simultaneously escape the cavity 34 of the container 30 through the release valve 40 as illustrated in FIG. 6. The absorbent pad 65 also collects any liquid 12 that happens to travel through the release channel 56 thus preventing the liquid 12 from being spilled upon the user.

The present invention may now be discarded or refilled via the upper opening 35. If refilling the cavity 34, the valve cap 60 is rotated in a clockwise manner (i.e. tightened) to reseal the release channel 56 until the present invention is ready for use again.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A fluid dispensing system, comprising:

a container including an upper end, a lower end, a cavity and an upper opening, wherein said upper end is opposite said lower end;

wherein said upper opening extends within said upper end and wherein said cavity extends from said upper opening of said upper end toward said lower end; and a release valve including a channel extending through said release valve, wherein said release valve extends within said container adjacent said lower end;

wherein said release valve includes a valve cap positioned over an outer end of said channel and wherein said valve cap includes a sealing member, wherein said sealing member selectively extends within said channel to seal said channel.

2. The fluid dispensing system of claim 1, including a cover positioned over said upper end to selectively seal said upper opening.

3. The fluid dispensing system of claim 2, wherein said cover is comprised of a tab.

4. The fluid dispensing system of claim 3, wherein said tab is pivotally connected to said container.

5. The fluid dispensing system of claim 2, wherein said cover is comprised of an upper cap.

6. The fluid dispensing system of claim 5, wherein said upper cap is threadably connected to said container.

7. The fluid dispensing system of claim 1, wherein said cavity is vacuum sealed.

8. The fluid dispensing system of claim 1, including a liquid positioned within said cavity and selectively released via said upper opening.

9. The fluid dispensing system of claim 1, wherein an inner end of said channel of said release valve is vertically below said upper opening.

10. The fluid dispensing system of claim 9, wherein said upper opening is offset to a concentric axis of said container.

11. The fluid dispensing system of claim 1, wherein said valve cap is threadably attached to said release valve.

12. The fluid dispensing system of claim 1, wherein said valve cap includes at least one cap opening extending through said valve cap.

13. The fluid dispensing system of claim 12, wherein said valve cap includes an absorbent pad extending across said at least one cap opening.

14. The fluid dispensing system of claim 1, including a base, wherein said lower end of said container is positioned within said base.

15. A fluid dispensing system, comprising:

a container including an upper end, a lower end, a cavity and an upper opening, wherein said upper end is opposite said lower end;

said upper opening offset from a concentric axis of said container;

wherein said upper opening extends within said upper end and wherein said cavity extends from said upper opening of said upper end toward said lower end;

a cover extending over said upper opening, wherein said cover selectively seals said upper opening; and a release valve including a channel extending through said release valve, wherein said release valve angularly extends within a sidewall of said container adjacent said lower end;

wherein said release valve includes a hollow air needle extending through said channel, said air needle having an upper end and a lower end, said upper end of said air needle being directly sealed by said release valve and said lower end of said air needle extending within a lower corner of said cavity directly below said upper opening, said lower corner being across said container from said release valve.

16. The fluid dispensing system of claim 15, wherein said cover is comprised of a tab, wherein said tab is pivotally connected to said container.

17. The fluid dispensing system of claim 15, wherein said cover is comprised of an upper cap, wherein said upper cap is threadably connected to said container.

18. A fluid dispensing system, comprising:

a container including an upper end, a lower end, a cavity and an upper opening, wherein said upper end is opposite said lower end;

wherein said upper opening extends within said upper end and wherein said cavity extends from said upper opening of said upper end toward said lower end;

a cover extending over said upper opening, wherein said cover selectively seals said upper opening; and a release valve including a channel extending through said release valve, wherein said release valve extends within said container adjacent said lower end;

wherein said release valve selectively seals said channel;

wherein an inner end of said channel of said release valve is vertically below said upper opening;

wherein said upper opening is offset to a concentric axis of said container;

wherein said release valve includes a valve cap positioned over an outer end of said channel;

wherein said valve cap includes a sealing member, wherein said sealing member selectively extends within said channel;

wherein said valve cap includes at least one cap opening extending through said valve cap.

19. The fluid dispensing system of claim 1, wherein said valve cap is movably connected to said release valve with respect to a lengthwise axis of said release valve.

20. The fluid dispensing system of claim 19, wherein said valve cap includes a lip extending inwardly therefrom, said lip adapted to engage said release valve for prohibiting removal of said valve cap from said release valve.

* * * * *